United States Patent [19]

Gregor et al.

[11] 4,225,393

[45] Sep. 30, 1980

[54] DOOR-REMOVAL DEVICE

[75] Inventors: Karl Gregor, Bochum; Karl Feldhaus, Gelsenkirchen, both of Fed. Rep. of Germany

[73] Assignee: Gewerkschaft Schalker Eisenhütte, Gelsenkirchen, Fed. Rep. of Germany

[21] Appl. No.: 915,380

[22] Filed: Jun. 14, 1978

Related U.S. Application Data

[63] Continuation-in-part of Ser. No. 869,173, Jan. 13, 1978, abandoned.

[30] Foreign Application Priority Data

Dec. 10, 1977 [DE] Fed. Rep. of Germany ..... 2755108

[51] Int. Cl.[2] ..... C10B 25/00; B66C 13/00

[52] U.S. Cl. ..... 202/248; 212/166

[58] Field of Search ..... 212/4; 202/248, 242

[56] References Cited

U.S. PATENT DOCUMENTS

| | | | |
|---|---|---|---|
| 3,948,397 | 4/1976 | Ikio | 212/4 |
| 4,089,424 | 5/1978 | Steimann et al. | 212/4 |

FOREIGN PATENT DOCUMENTS

| | | | |
|---|---|---|---|
| 577100 | 6/1959 | Canada | 202/248 |
| 707351 | 4/1954 | United Kingdom | 202/248 |
| 707363 | 4/1954 | United Kingdom | 202/248 |
| 729414 | 5/1955 | United Kingdom | 202/248 |
| 768319 | 2/1957 | United Kingdom | 202/248 |
| 792970 | 4/1958 | United Kingdom | 202/248 |

*Primary Examiner*—Frank W. Lutter
*Assistant Examiner*—Roger F. Phillips
*Attorney, Agent, or Firm*—Karl F. Ross

[57] ABSTRACT

A device for the removal of a coke-oven door, engaging the door frame of a coking chamber by one or more swingable latch arms that are axially loaded by Belleville springs, comprises a support carrying one or more unlatching heads alignable with the swing axes of respective latch arms along which that body can be moved toward and away from the door by a hydraulic jack linked with a fixed or separately movable base. Each unlatching head comprises a gripper rod axially movable inside a pressure sleeve by means of a hydraulic actuator. The gripper rod has a pair of claws which, when that rod is brought into contact with a knob on a pivot stud of the associated latch arm, are cammable into engagement with this knob by a forward thrusting of the pressure sleeve through the hydraulic actuator. The sleeve then comes to bear upon a collar surrounding the pivot stud whereby an extension of this collar compresses the Belleville springs behind the latch to relieve their pressure upon that arm. The latch arm is now swingable out of frictional engagement with the door frame to facilitate the removal of the door from its frame by the receding support.

9 Claims, 8 Drawing Figures

CONTROL PANEL

DOOR-REMOVAL DEVICE

CROSS-REFERENCE TO RELATED APPLICATION

This is a continuation-in-part of our copending application Ser. No. 869,173 filed Jan. 13, 1978 and now abandoned.

FIELD OF THE INVENTION

Our present invention relates to a device for the removal of a heavy-duty door, such as that of a coking chamber, from a door frame to which the door is normally secured by a frame-engaging latch arm swingable about a horizontal pivot stud.

BACKGROUND OF THE INVENTION

Doors of the type herein contemplated, such as those used on coke ovens, are removable from their door frames to facilitate the emptying of the corresponding coking chambers, e.g. as described in commonly owned patent application Ser. No. 651,777 filed Jan. 23, 1976 by one of us, Karl Gregor, jointly with Kurt Asmus, now U.S. Pat. No. 4,153,515. After the door and its frame have been separately cleaned, the door-removal device is operated in reverse to re-emplace the door on the frame to which it is then again latched.

The latch arms used for this purpose, when in an operative position, are under axial pressure of spring means—usually a stack of Belleville springs—urging their extremities into frictional engagement with respective lands on the door frame. The pivot stud is surrounded by an axially shiftable thrust member, usually of annular shape, which has an inward extension or skirt contacting the stack of Belleville springs to relieve their pressure when the thrust member is repressed, thereby allowing the latch arm to be swung out of engagement with the coacting lands of the door frame. Such repression is performed by an unlatching head supported on the body of the door-removal device after the latter has been advanced from a withdrawn position into a working position by hydraulic drive means anchored to that body and to an associated base. The base may be designed as a carriage movable along a coke-oven battery to align the door-removal device with the door frames of the several coking chambers, as also described in the aforementioned commonly owned U.S. Pat. No. 4,153,515.

Since a hydraulic jack serving as the drive means for the advance and withdrawal of the door-removal device generally does not have the power required to release the latch arm or arms of a coke-oven door aligned therewith, the unlatching head is provided with a separate power source. Heretofore, that power source has been a supply of pneumatic pressure operable to engage respective parts of the unlatching head, namely a gripper element and a pressure element, with an outwardly projecting tip of the pivot stud, designed as a knob, and with the surrounding thrust member. These conventional unlatching heads have separate pneumatic pistons and cylinders for the repression of the thrust member during door removal and for the reverse motion during relatching upon re-emplacement of the door.

The use of compressed air as the pressure fluid in such a device allows the spent fluid to be simply discharged into the atmosphere. Since, however, the displacement of the device itself on its base is generally performed by hydraulic drive means, it would be more convenient to operate the unlatching head or heads also by hydraulic fluid. The mechanical and fluidic problems encountered in such a case, however, have not been satisfactorily solved heretofore as far as we are aware.

OBJECTS OF THE INVENTION

The general object of our present invention, therefore, is to provide a door-removal device of the character described above whose unlatching head or heads can be hydraulically operated without requiring any structural changes in the latching mechanism conventionally used on coke-oven doors or the like.

A more particular object is to provide means in such a device allowing for a lack of exact alignment between the axis of an unlatching head and the swing axis of an associated latch arm.

SUMMARY OF THE INVENTION

In accordance with our present invention, we provide hydraulic actuating means operable—independently of the hydraulic drive means for the displacement of the body of the door-removal device—for repressing the thrust member of a latched door while obtaining a purchase on the pivot stud thereof, the actuating means including a cylinder connectable to a source of hydraulic fluid and mechanically linked with one of the two relatively movable elements, a preferably double-acting piston in that cylinder mechanically linked with the other of these elements, and valve means controlling the admission of hydraulic fluid from the source to the cylinder.

Advantageously, to facilitate an engagement of the gripper element with the knob of the pivot stud before contact is made between the pressure element and the thrust member, the pressure element is normally held in a retracted position relative to the gripper element by hydraulic pressure and/or by separate biasing means such as a spring.

As more particularly described hereinafter, and in conformity with conventional practice, the pressure element is preferably a sleeve centered on the swing axis of the latch arm in the working position of the device while the gripper element is a rod coaxially surrounded by the sleeve and provided with one or more claws designed to engage the knob of the pivot stud. Such engagement is brought about by camming means inside the sleeve coacting with the claw or claws upon forward displacement of the sleeve relative to the rod.

In order to allow for a possible axial disalignment between the latch arm and the unlatching head, e.g. after removal of the door from its frame when the door is held on the device by door-engaging means such as hooks offset from the unlatching head, we prefer to introduce a certain flexibility into the mounting of the hydraulic actuator on the body of the device. Thus, if the cylinder and the gripper rod are rigid with that body while the pressure sleeve is slidably guided thereon with a certain amount of play, the sleeve may be linked with the hydraulic piston by way of an articulated joint. On the other hand, if the hydraulic piston is rigid with the gripper rod while the cylinder is rigid with the pressure sleeve, that sleeve may be anchored to the body of the device by a flexible connection. At least the sleeve, therefore, will have a limited lateral mobility with reference to its support.

BRIEF DESCRIPTION OF THE DRAWING

The above and other features of our invention will now be described in detail with reference to the accompanying drawing in which.

SPECIFIC DESCRIPTION

Figure 1:
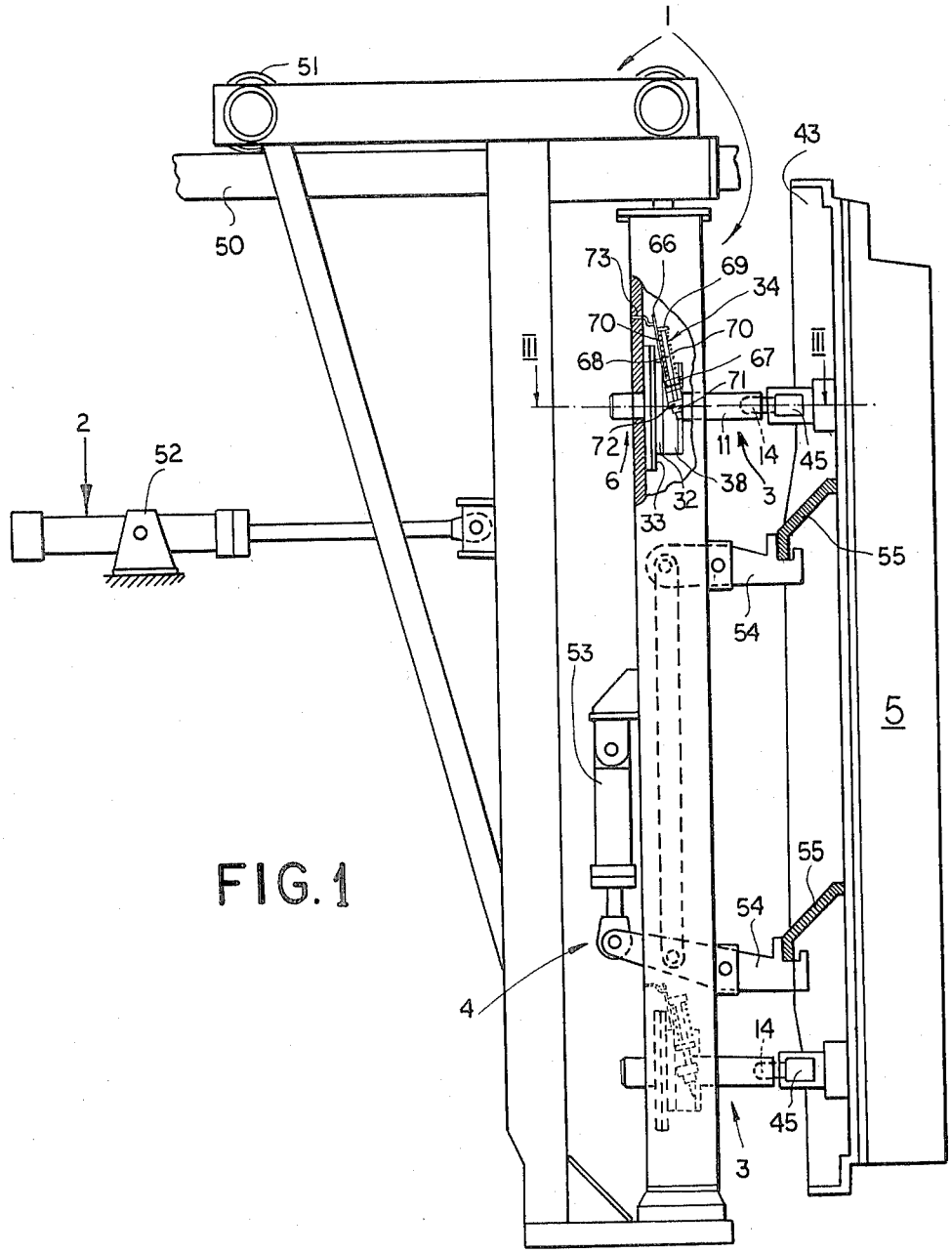
FIG. 1 is a side-elevational view of a door-removal device according to our invention.
Figure 7:
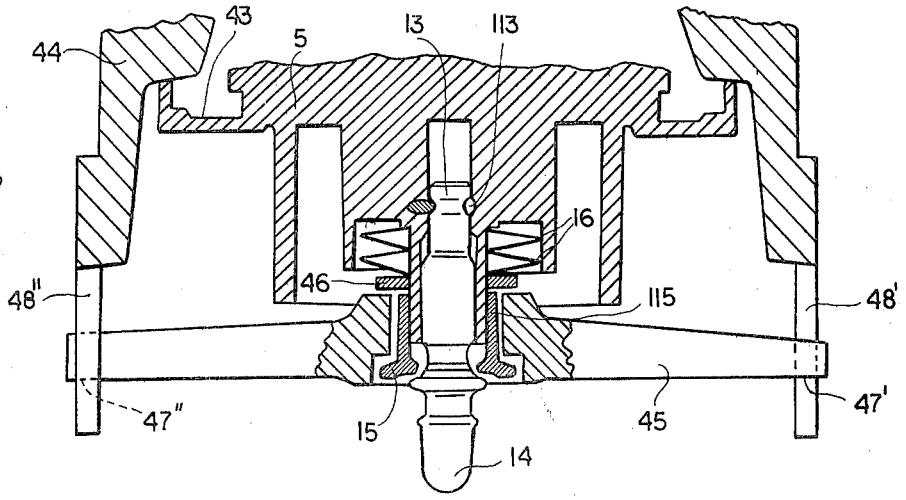
FIG. 7 is a fragmentary sectional top view of a door latched to a door frame of a coking chamber.

In FIG. 1 we have shown a door-removal device comprising a support 1 having wheels 51 by which it is displaceably mounted on a pair of overhead beams 50 (only one shown) which form part of a base not illustrated further, except for a mounting 52 of a hydraulic jack 2. Base 50, 52 may in turn be part of a carriage movable along a coke-oven battery as described in commonly owned U.S. Pat. No. 4,153,515 referred to above. A chamber of that coke-oven battery, having a door frame 44 as seen in FIG. 7, is normally closed by a door 5 provided with a sealing frame 43 by which it comes to rest against shoulders of door frame 44. The door 5 carries two latch arms 45 each centered on a pivot stud 13 whose front end is formed by a knob 14 traversing the arm 45, with interposition of an annular thrust member in the form of a collar 15 having a tubular inward extension or skirt 115. This skirt bears, via a flat ring 46, upon a stack of Belleville springs 16 lodged in a recess of door 5; stud 13 is fixedly anchored to the door by a split ring 113.

In the closure position of FIG. 7, the extremities of latch arm 45 are pressed by the Belleville springs 16 against lands 47', 47" formed by a pair of hook-shaped extensions or wings 48', 48" of door frame 44. Owing to the frictional contact between these lands and the extremities of latch arm 45, the latter cannot be swung out of its locking position until the springs 16 are repressed by an inward thrust exerted upon collar 15. For this purpose, as shown in FIG. 1, support 1 carries a pair of unlatching heads 3 coaxially aligned with the two latch arms 45 and provided with respective hydraulic actuators 6. Each of these unlatching heads has a pressure sleeve 11 which, upon being hydraulically driven forward (to the right in FIG. 1) as more fully described hereinafter, represses the associated collar 15 (FIG. 7). At the same time, hooks 54 swingably mounted on support 1 are operated by a hydraulic jack 53 to engage respective brackets 55 on the door which, after unlatching, can then be withdrawn from its door frame by the driving jack 2. Also shown in FIG. 1 are resilient links 34 which, in a manner described hereinafter with reference to FIGS. 3–6, urge a shoulder of sleeve 11 rearwardly against an abutment surface 33 of support 1.

Figures 2A, 2B:
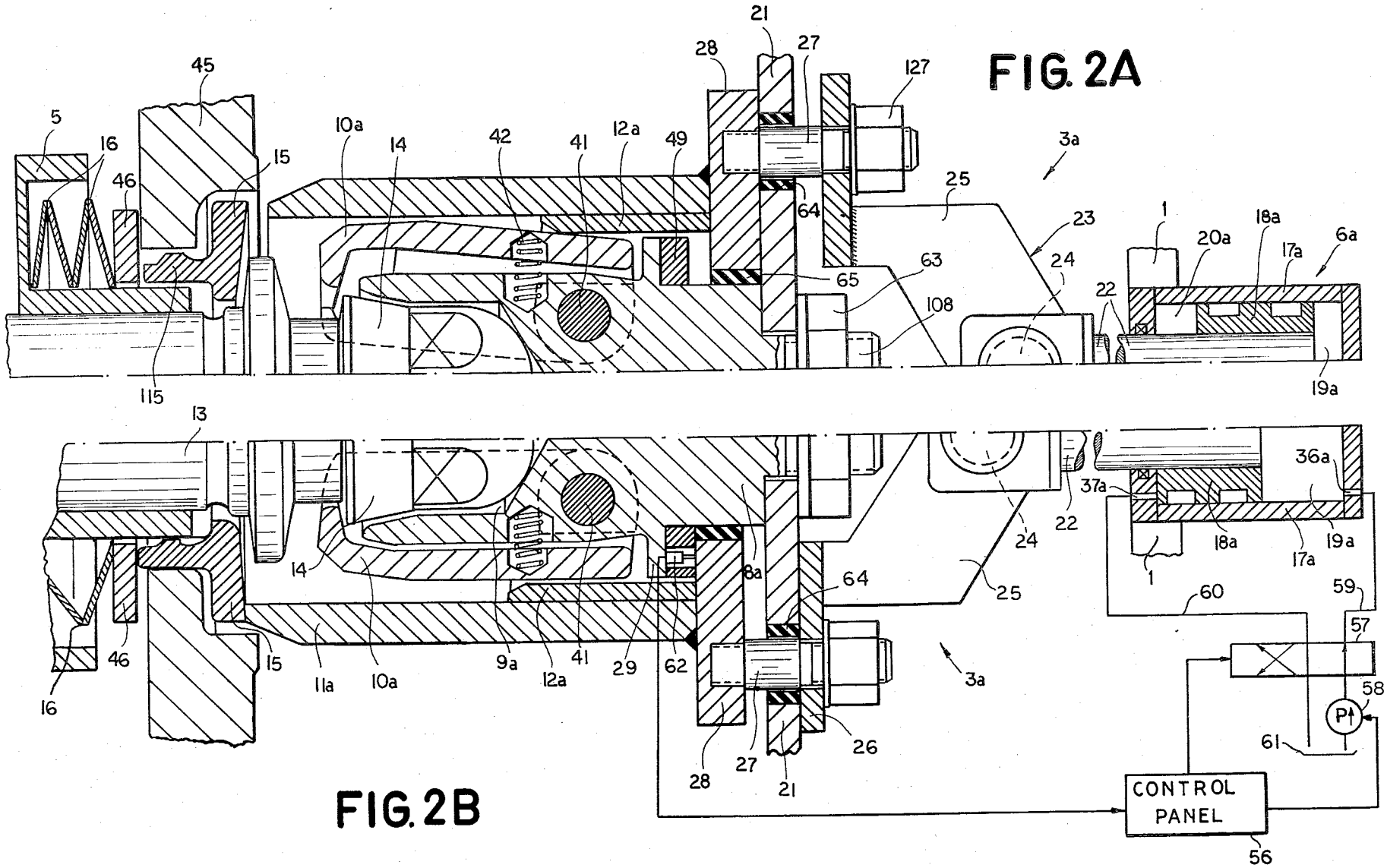
FIGS. 2A and 2B are two mutually complementary axial sectional views, in different positions, of an unlatching head for a device similar to that shown in FIG. 1.

In FIGS. 2A and 2B we have illustrated a modified unlatching head 3a which could be used in place of either head 3 on the supporting body 1 of FIG. 1 (details of head 3 will be discussed hereinafter with reference to FIGS. 3–6). Unlatching head 3a comprises a gripper rod 8a which is fixedly clamped, by a nut 63 engaging a threaded extension 108 thereof, to a support plate 21 rigid with body 1. Also fixedly secured to that body is a cylinder 17a, forming part of a hydraulic actuator 6a, receiving a double-acting piston 18a which defines with the rear wall of that cylinder an expandable pressure chamber 19a. On the opposite side of piston 18a, i.e. at the front wall of the cylinder, there is formed another chamber 20a which, however, nearly disappears when the piston is shifted forwardly (to the left) from the position of FIG. 2A to that of FIG. 2B. The admission of hydraulic fluid (oil) to chambers 19a and 20a is controlled, manually or via a nonillustrated programmer, by way of a panel 56 acting upon a valve 57 through which the output of a pump 58 can be alternately connected to a line 59, communicating with a port 36a at the rear cylinder wall, or to a line 60, communicating with a port 37a at the front cylinder wall. The chamber not pressurized by pump 58 is drained via valve 57 to a sump 61.

Piston 18a has a piston rod 22 connected via an articulated joint 23 with a pressure sleeve 11a coaxially surrounding the gripper rod 8a. Joint 23 comprises a hinge pin 24 linking the piston rod 22 with a yoke 25, the latter being welded to a backing plate 26 lying behind mounting plate 21. Bolts 27, provided with nuts 127, are fastened to plate 26 and are threaded into a ring 28 which lies in front of plate 21 and is rigid with sleeve 11a. The bolts 27 pass with some clearance through respective apertures of plate 21 having linings 64 of rubber or the like whereby sleeve 11a has a certain mobility relative to that plate and therefore to support 1. This mobility is only slightly impeded by a resilient bushing 65 through which the ring 28 is in sliding contact with gripper rod 8a.

A peripheral shoulder 29 of sleeve rod 8a is separated by an annular disk 49 from the ring 28 and limits the forward shift of the sleeve 11a relative to rod 8a upon the advance of piston 18a into the working position of FIG. 2B. Shoulder 29 and disk 49 are surrounded by a camming ring 12a which is press-fitted into sleeve 11a and coacts with a pair of claws 10a hinged to gripper rod 8a by pins 41. Coil springs 42 normally keep the claws 10a in an outwardly retracted position, as seen in FIG. 2A, allowing free introduction of the knob 14 of pivot stud 13 into a front recess 9a of rod 8a and also permitting the withdrawal of that rod from the knob. Upon forward motion of sleeve 11a, however, camming ring 12a depresses the claws 10a against the force of their biasing springs 42 into the knob-engaging position illustrated in FIG. 2B.

When the mobile support 1 is brought forward by the hydraulic jack 2 (FIG. 1) so that unlatching head 3a approaches the latch arm 45, piston 18a is retracted as shown in FIG. 2A whereby claws 10a are withdrawn and pressure sleeve 11a is well separated from collar 15 as knob 14 comes to rest against the bottom of recess 9a at the front end of rod 8a. At this stage, the pressure differential existing between cylinder chambers 19a and 20a holds the ring 28 in contact with mounting plate 21 so that chamber 19a has its smallest volume. Belleville springs 16 inside door 5 exert their full pressure, through ring 46, upon the latch arm 45 whose ends are therefore in firm frictional contact with lands 47' and 47" of the wings 48' and 48" of door frame 44 (see FIG. 7).

When the control panel 56 shifts the valve 57 to the position illustrated in FIG. 2B, the advance of sleeve 11*a* closes the claws 10*a* behind the knob 14 whereby the rod 8*a* obtains a purchase on the pivot stud 13, preventing it from being entrained by the thrust member 15, 115 when the latter is repressed by the advancing sleeve 11*a* against the force of Belleville springs 16. After the pressure sleeve has reached its limiting forward position of FIG. 2B, defined by the engagement of ring 28 with disk 49, latch arm 45 can be readily swung out of engagement with the door frame after the hooks 54 of FIG. 1 have been operated to support the door 5 on the mobile body 1 independently of the unlatching heads 3*a*. The advanced position of pressure sleeve 11*a* and its engagement with collar 15 are maintained as long as the door 5 is supported on body 1. Upon its subsequent re-emplacement in door frame 44 and the re-engagement of latch arm 45 with wings 48', 48", the aforedescribed motions are reversed by application of hydraulic pressure to chamber 20*a* and simultaneous draining of chamber 19*a*. Sleeve 11*a* thereupon disengages itself from collar 15 to relock the latch, claws 10*a* are released and head 3*a* can be retracted from the door 5 by the jack 2 of FIG. 1.

Figure 3:
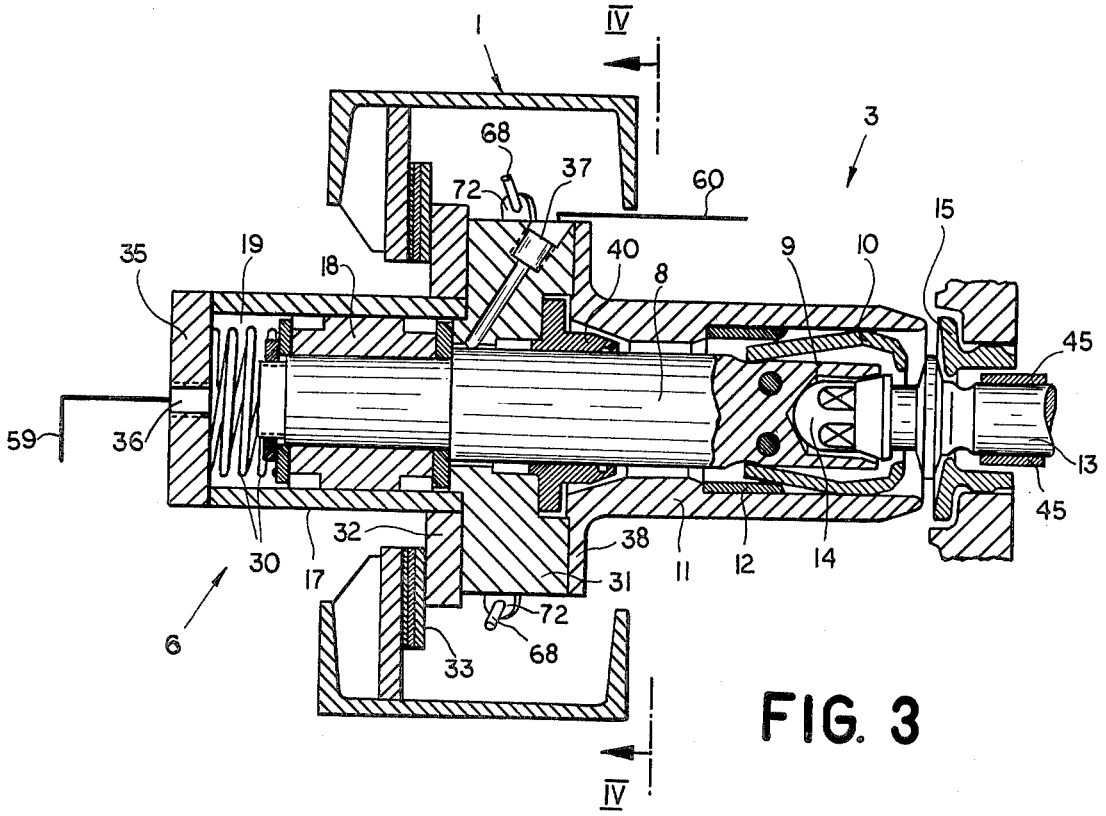
FIG. 3 is an axial sectional view of another unlatching head, taken on the line III—III of FIG. 1 but drawn to a larger scale.
Figure 4:
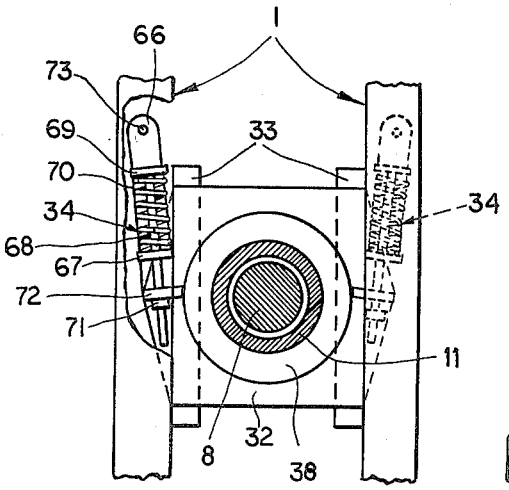
FIG. 4 is a cross-sectional view of the unlatching head of FIG. 3, taken on the line IV—IV thereof.
Figure 5:
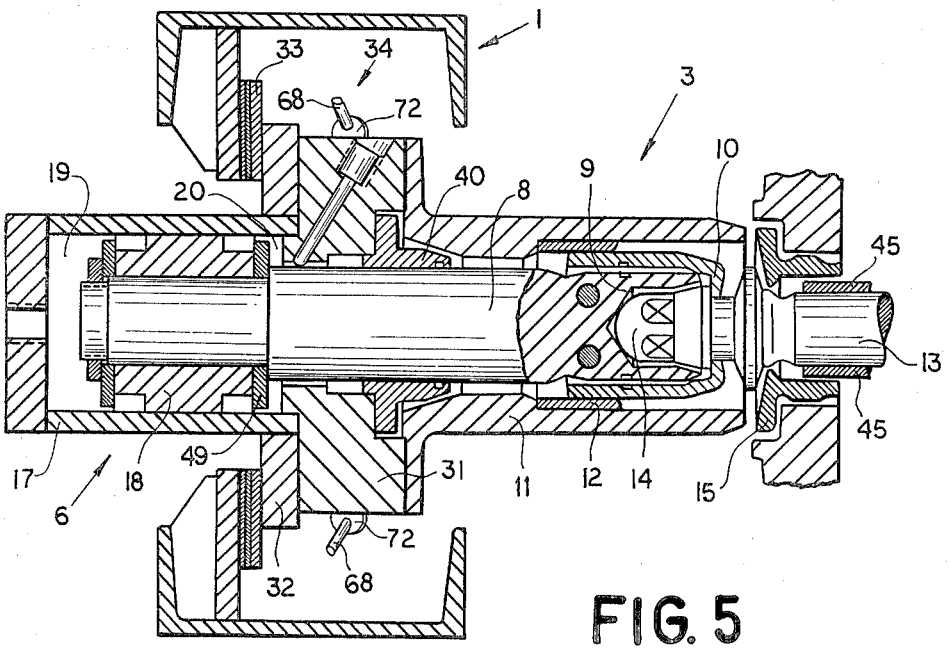
FIGS. 5 and 6 are views similar to FIG. 3 but showing the unlatching head in different operating positions.
Figure 6:
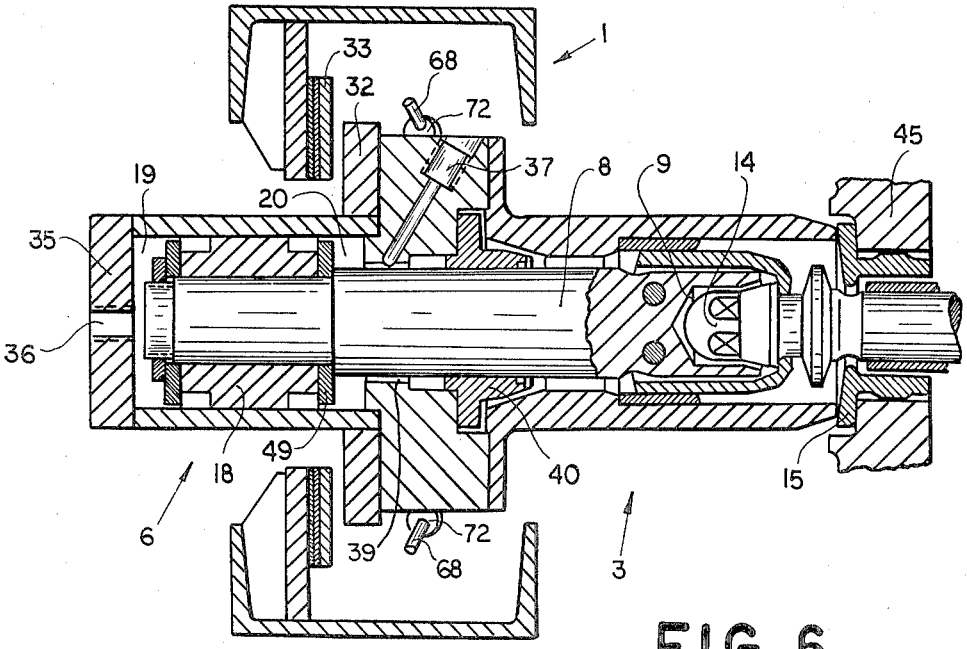

The construction of unlatching head 3, illustrated in FIGS. 3–6, differs from that of head 3*a* mainly in that its hydraulic actuator 6 comprises a cylinder 17 rigid with pressure sleeve 11 and a piston 18 mounted directly on an extension of the associated gripper rod 8 bearing claws 10. A chamber 19 of cylinder 17 is normally pressurized via a port 36 in a rear cylinder wall 35 from the line 59 of the hydraulic system illustrated in FIG. 2B whose other line 60 terminates at a lateral port 37 in a ring 31 which constitutes a radial enlargement of sleeve 11. Ring 31 is fixedly connected, in a manner not further illustrated, with a peripheral shoulder 38 of sleeve 11 and with a centrally perforated hexagonal backing plate 32 which in turn is rigid with cylinder 17. Port 37 terminates at a peripheral clearance 39 which opens into a chamber 20 formed between piston 18 and ring 31 when the piston is retracted (to the left) as illustrated in FIGS. 5 and 6. The fluid pressure in chamber 19, designed to hold the sleeve 11 retracted with reference to rod 8 prior to an unlatching operation, may be supplemented or replaced by the pressure of a spring 30 shown in FIG. 3. At its forward end, clearance 39 is bounded by an annular insert 40 closely surrounding the rod 8 and resting against ring 31. A recess 9 at the front of rod 8 receives the knob 14 of a pivot stud 13 aligned therewith.

In this embodiment, actuator 6 forms with rod 8 and sleeve 11 a structural unit mounted with a certain degree of mobility on the support 1 to allow for minor disalignments as discussed above. The mounting comprises resilient suspension means constituted by contractile links 34 already referred to in connection with FIG. 1. As best seen in FIG. 4, each link 34 comprises a bracket 66 with a bent-up extremity 67 traversed by a stem 68 which terminates in a head 69 and is surrounded by a coil spring 70 compressed between formations 67 and 69. Stem 68 is held by a nut 71 in a lug 72 integral with the ring 31 (which in FIG. 4 is hidden behind shoulder 38) whereas bracket 66 is anchored to the carrier body 1 by a hook 73. The two contractile links 34 are seen to diverge rearwardly and upwardly from ring 31 to support the weight of the unlatching head 3 and to hold its backing plate 32 in contact with abutment surface 33 of carrier body 1. Thus, the links 34 constitute the sole connection between the carrier and the tubular assembly 11, 17, 31 surrounding the rod 8 and the piston 18 rigid therewith.

The operation of unlatching head 3 is generally similar to that of unlatching head 3*a*, with FIG. 3 showing the normal retracted position of sleeve 11 relative to rod 8, FIG. 5 illustrating the intermediate position in which the associated camming ring 12 depresses the claws 10 to engage the knob 14 of pivot stud 13, and FIG. 6 illustrating the advanced or working position designed to release the latch arm 45. In the intermediate position of FIG. 5, sleeve 11 does not yet contact the collar 15 and is still held by links 34 with its backing plate 32 against the abutment surface 33. The further enlargement of the volume of pressure chamber 20, in the final phase of the unlatching stroke, moves the sleeve 11 forward since the rod 8 can no longer recede from the door carrying the latch arm 45. At this point, therefore, a gap develops between plate 32 and surface 33 even as sleeve 11 represses the collar 15 against the force of the associated Belleville springs.

Since the use of a biasing spring 30 in chamber 19 allows the piston 18 to be of the single-acting type, port 36 and line 59 could be omitted. We prefer, however, to use a double-acting hydraulic system in all instances because of its greater reliability. In any event, pump 58 (FIG. 2B) should be provided with the usual overflow conduit controlled by a pressure-relief valve; this pump could also be used to actuate the jack 53 shown in FIG. 1. Though the pump 58 is to remain operated as long as a door 5 removed from its frame 44 is carried on supporting body 1, it may be desirable to reduce the pumping speed and thereby to minimize the wasteful circulation of oil when the pressure sleeve 11 or 11*a* of unlatching head 3 or 3*a* has been fully advanced into the working position illustrated in FIG. 6 or 2B. This may be accomplished with the aid of a suitable sensor detecting the arrival of the sleeve in that working position, as illustrated by way of example in FIG. 2B where a switch 62 on the shoulder 29 of rod 8*a* coacts with the ring 28 and reports to control panel 56 the establishment of contact between that ring and disk 49. A similar sensing switch on backing plate 32 (FIGS. 3–6), for instance, could operate in an analogous manner when that backing plate leaves the abutment surface 33 of support 1 as seen in FIG. 6.

We claim:

1. In a device for the removal of a heavy-duty door from a door frame to which the door is normally secured by a frame-engaging latch arm swingable about a horizontal pivot stud provided with an outwardly projecting knob, said latch arm being under pressure of spring means centered on its swing axis whereby the extremities of the latch arm are urged into frictional engagement with respective lands on the door frame, the door being further provided with an axially shiftable thrust member which surrounds said pivot stud forwardly of the latch arm and has an inward extension contacting said spring means for relieving the pressure thereof upon an inward repression of said thrust member to allow a swinging of the latch arm out of engagement with said lands, said device including a mobile body displaceable along a base in the direction of said axis and provided with door-engaging means, hydraulic drive means anchored to said base and to said body for displacing the latter between a withdrawn position remote from said door frame and an advanced position close to said door frame, said door-engagement means being operative in said advanced position, unlatching means on said body including a gripper rod and a surrounding pressure sleeve limitedly relatively movable along said axis, said gripper rod having cam-controlled claw means engageable in said advanced position with the knob of a door latched to said door frame for obtaining a purchase on said pivot stud, said pressure member being aligned with the thrust member of the latched door in said advanced position, and hydraulic actuating means operable independently of said drive means for repressing said thrust member to facilitate a disengagement of said latch arm from said lands, said actuating means including a cylinder connectable to a source of hydraulic fluid, a piston in said cylinder, and valve means controlling the admission of hydraulic fluid from said source to said cylinder, the improvement wherein said actuating means forma a structural unit with said gripper rod and said pressure sleeve, said piston being rigid with said gripper rod, said cylinder constituting an extension of said pressure sleeve and forming therewith a tubular assembly around said gripper rod and said piston, said tubular assembly being anchored to said body by a flexible connection.

2. The device defined in claim 1 wherein said sleeve has a peripheral shoulder, said body having an abutment surface adjoining a rear side of said shoulder facing away from the door frame, said flexible connection comprising a resilient linkage holding said shoulder onto said abutment surface.

3. The device defined in claim 2 wherein said resilient linkage comprises a pair of contractile links attached to said shoulder and diverging therefrom in a rearward and upward direction.

4. The device defined in claim 1, 2 or 3 wherein said piston and said cylinder define with each other a normally pressurized chamber holding said pressure sleeve retracted with reference to said gripper rod.

5. The device defined in claim 4 wherein said cylinder is provided with a first port opening into said normally pressurized chamber and with a second port opening into said cylinder at a location separated by said piston from said normally pressurized chamber, said ports being alternately connectable to said source by said valve means.

6. The device defined in claim 5 wherein said first port is located at a rear wall of said cylinder and said second port is laterally disposed in an intermediate area of said tubular assembly.

7. The device defined in claim 4, further comprising biasing means independent of said source tending to retract said pressure element with reference to said gripper element.

8. The device defined in claim 7 wherein said biasing means comprises a spring in said normally pressurized chamber.

9. The device defined in claim 1, further comprising sensing means on said unlatching means and control means responsive to said sensing means for operating said valve means to limit the hydraulic pressure of said actuating means upon a predetermined repression of said thrust member by said pressure element.

* * * * *